US005155978A

United States Patent [19]

Watanabe

[11] Patent Number: 5,155,978

[45] Date of Patent: * Oct. 20, 1992

[54] COIN WRAPPING MACHINE

[75] Inventor: Kenkichi Watanabe, Kawasaki, Japan

[73] Assignee: Laurel Bank Machines Co., Ltd., Tokyo, Japan

[ * ] Notice: The portion of the term of this patent subsequent to Sep. 1, 2009 has been disclaimed.

[21] Appl. No.: 742,338

[22] Filed: Aug. 8, 1991

[30] Foreign Application Priority Data

Aug. 9, 1990 [JP] Japan ..... 2-210897

[51] Int. Cl.[5] ..... B65B 11/04; B65B 35/50

[52] U.S. Cl. ..... 53/532; 53/540; 53/212

[58] Field of Search ..... 53/532, 540, 211, 465

[56] References Cited

U.S. PATENT DOCUMENTS 3,412,524 11/1968 Nestell ..... 53/212
4,219,985 9/1980 Uchida et al. ..... 53/212
4,729,211 3/1988 Sakurai ..... 53/212

FOREIGN PATENT DOCUMENTS 1053357 12/1966 United Kingdom .
2187162 9/1987 United Kingdom .

*Primary Examiner*—John Sipos
*Attorney, Agent, or Firm*—Keck, Mahin & Cate

[57] ABSTRACT

A coin wrapping machine having a pair of stacking drums rotatable in opposite directions, spiral coin support guides formed on the pair of stacking drums for supporting coins by their upper faces and stacking coins and a plurality of wrapping rollers for wrapping the thus stacked coins, the coin wrapping machine further including a plurality of pressurized air blowers which are disposed in such a manner that a blowing opening of each pressurized air blower faces a portion between the wrapping rollers and are adapted to blow pressurized air toward a leading edge of a wrapping paper. The thus constituted coin wrapping machine can be made considerably compact.

35 Claims, 8 Drawing Sheets

COIN WRAPPING MACHINE

BACKGROUND OF THE INVENTION

The present invention relates to a coin wrapping machine capable of being made compact and, in particular, to such a coin wrapping machine having a pair of stacking drums for stacking coins to be wrapped and a plurality of wrapping rollers for wrapping stacked coins of a predetermined number by a wrapping paper.

DESCRIPTION OF PRIOR ART

U.S. Pat. No. 4,729,211 discloses a coin wrapping machine comprising a coin stacking apparatus having a pair of stacking drums disposed at the terminal portion of a coin passage where coins are fed one by one so as to be spaced at the same interval as the width of the coin passage and being formed with spiral coin guides on the outer periphery thereof for supporting coins in such a manner that one spiral extends in the opposite direction to the other but the two spirals extend in phase with each other, the coin stacking apparatus being adapted for rotating the pair of stacking drums in opposite directions by a predetermined amount each time one coin is fed from the coin passage, thereby to stack coins on the spiral coin guides and place the roll-like stacked coins on a shutter capable of being opened and closed after a predetermined number of coins have been stacked, and a coin wrapping apparatus having a movable support member disposed below the shutter of the coin stacking apparatus for supporting the stacked coins which fall when the shutter is opened, three movable wrapping rollers and a pair of crimp claws one being disposed above the wrapping rollers and the other being disposed below the wrapping rollers, wherein after the coins stacked by the coin stacking apparatus have been delivered to the support member, the stacked coins are positioned among the three wrapping rollers by moving the support member, a wrapping paper is wound around the roll-like stacked coins, and a predetermined number of coins are wrapped by crimping the upper portion and the lower portion of the wrapping paper by the crimp claws.

Further, U.S. Pat. No. 4,219,985 discloses a wrapping paper guide apparatus for this kind of coin wrapping machine, which includes a plurality of guide plates for guiding the leading edge of a wrapping paper along the periphery of the stacked coins.

In this conventional coin wrapping machine, when the denomination of coins to be wrapped is changed, since the diameter thereof is changed, it is inevitably necessary to change the positions of a plurality of guide plates for guiding the leading edge of the wrapping paper along the periphery of the stacked coins. Therefore, the wrapping paper guide apparatus has to be provided with an adjustment mechanism for adjusting the positions of the wrapping paper guide plates in accordance with the denomination of the coins to be wrapped.

However, since the adjustment mechanism is conventionally constituted so as to adjust the positions of the guide plates by swinging a plurality of links by a cam having a predetermined cam profile, the structure thereof is complicated and it is difficult to make the mechanism compact. Therefore, it is difficult to make the coin wrapping machine compact.

SUMMARY OF THE INVENTION

It is, therefore, an object of the present invention to provide a coin wrapping machine which can make a wrapping paper guide apparatus for guiding the leading edge of a wrapping paper considerably more compact and simpler and is capable of being made considerably compact.

The above and other objects of the present invention can be accomplished by a coin wrapping machine having a pair of stacking drums rotatable in opposite directions, spiral coin support guide means formed on the pair of stacking drums for supporting coins by their upper faces and stacking coins and a plurality of wrapping rollers for wrapping the thus stacked coins, said coin wrapping machine further including a plurality of pressurized air blowing means which are disposed in such a manner that a blowing opening of each pressurized air blowing means faces a portion between said wrapping rollers and are adapted to blow pressurized air toward a leading edge of a wrapping paper.

In a preferred aspect of the present invention, the pair of stacking drums are hollow, the plurality of wrapping rollers comprises a pair of wrapping rollers, one of said wrapping rollers being disposed in each stacking drum in such a manner that a part thereof projects from an opening formed on the periphery of the stacking drum and that when coins are being wrapped, the coins can be held by the wrapping rollers and coin holding means disposed upstream of the pair of wrapping rollers with respect to the coin transportation direction, and there are provided first, second and third pressurized air blowing means in such a manner that a blowing opening of the first pressurized air blowing means faces a portion between the pair of wrapping rollers, a blowing opening of the second pressurized air blowing means faces a portion between the coin holding means and one of the wrapping rollers and a blowing opening of the third pressurized air blowing means faces a portion between the coin holding means and the other wrapping rollers.

In a further preferred aspect of the present invention, there are further provided cutter means for cutting the wrapping paper and cutter position adjusting means for adjusting the vertical position of the cutter means, the vertical positions of said pressurized air blowing means being adjustable in accordance with the vertical position of the cutter means adjusted by said cutter position adjusting means.

In a further preferred aspect of the present invention, there are further provided low speed motor means and high speed motor means for rotating the plurality of wrapping rollers in such a manner that the plurality of wrapping rollers are rotated by said low speed motor means until the wrapping paper has been wound around the periphery of the stacked coins substantially once and then rotated by said high speed motor means.

In a furthermore preferred aspect of the present invention, said plurality of pressurized air blowing means are constituted so as to blow pressurized air toward the leading edge of the wrapping paper only when the plurality of wrapping rollers are being rotated by said low speed motor means.

In a furthermore preferred aspect of the present invention, there is provided above the pair of stacking drums a guide roller which is biased downwardly.

In a furthermore preferred aspect of the present invention, there is provided coin support means which can advance to and retract from a portion below said pair of stacking drums, is located at a position where it is elevated to the highest level after coin stacking was started until coin wrapping has been completed and is adapted to receive the stacked coins after the coin stacking has been completed prior to the coin wrapping and support the stacked coins during the coin wrapping.

In a further preferred aspect of the present invention, said coin holding means comprises a driven roller.

The above and other objects and features of the present invention will become apparent from the following description made with reference to the accompanying drawings.

DESCRIPTION OF THE PREFERRED EMBODIMENT

Figure 1:
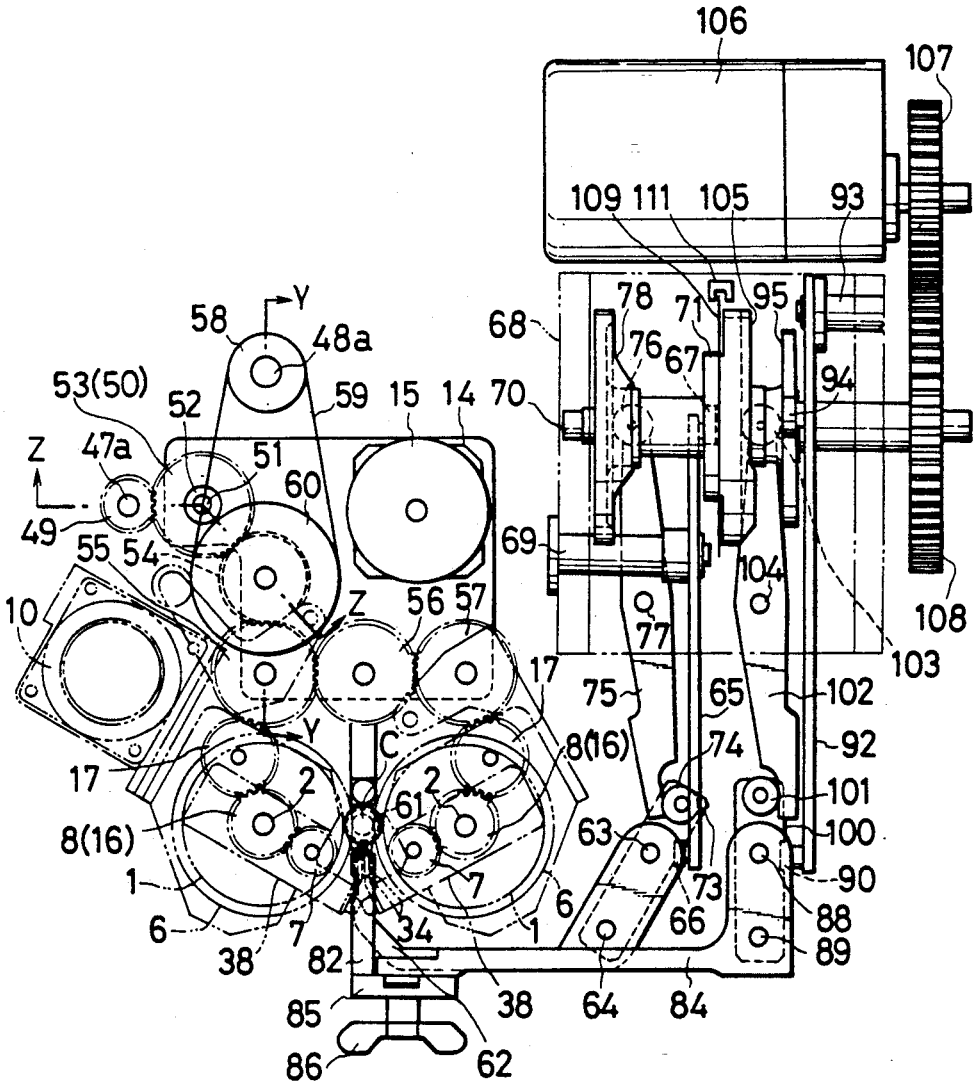
FIG. 1 is a schematic drawing showing a plan view of a coin wrapping machine which is an embodiment of the present invention.
Figure 2:
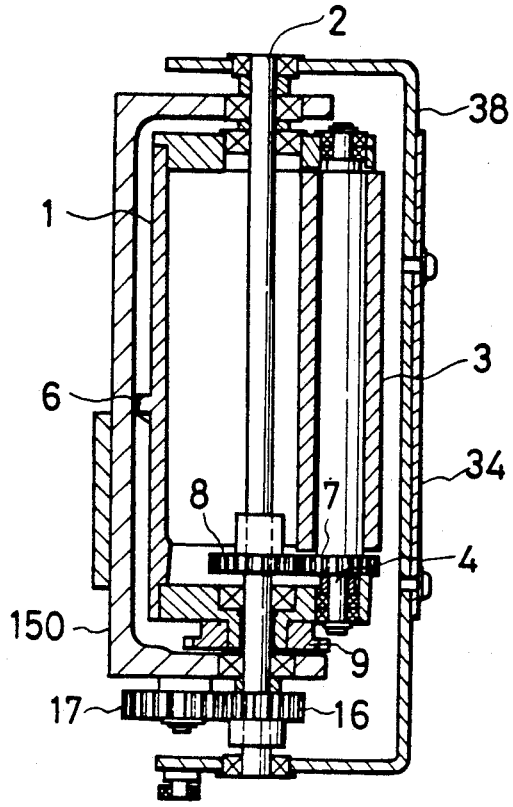
FIG. 2 is a schematic drawing showing a cross-sectional view of a stacking drum.
Figure 3:
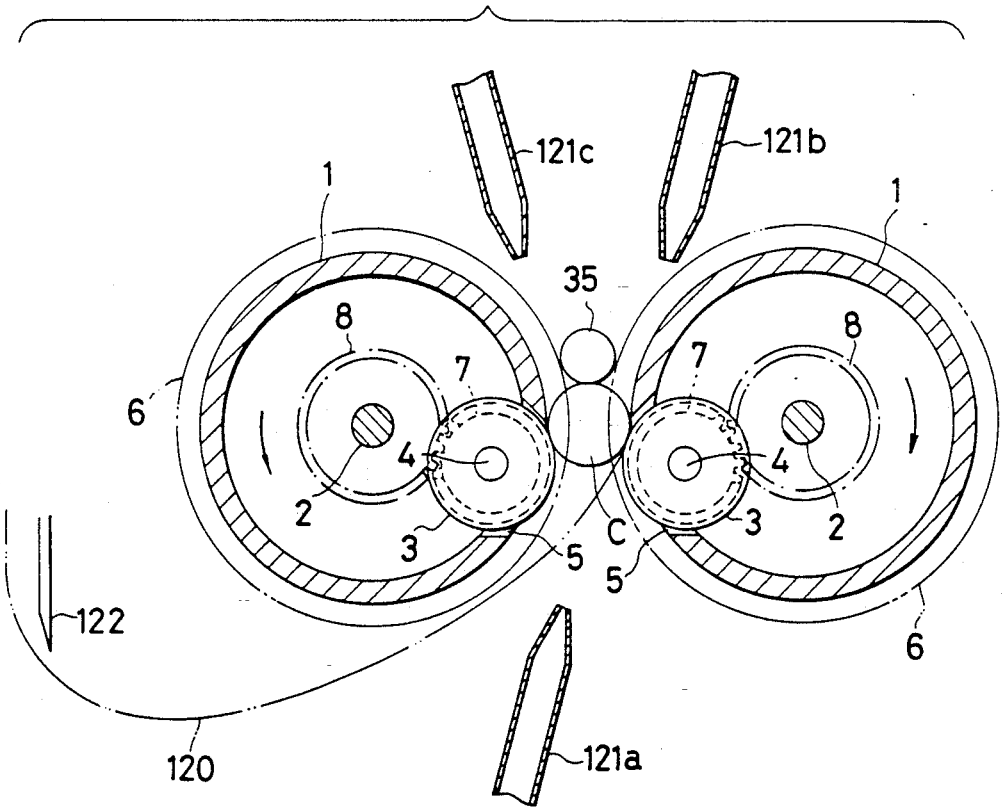
FIG. 3 is a schematic drawing showing a lateral cross-sectional view of a pair of stacking drum and a wrapping paper guiding apparatus.

Referring to FIGS. 1, 2 and 3, a pair of stacking drums 1, 1 are formed to be hollow and rotatably mounted on shafts 2, 2. In the pair of stacking drums 1, 1, wrapping rollers 3, 3 are respectively supported by shafts 4, 4 which are rotatably secured to the stacking drums 1, 1 so as to be parallel with shafts 2, 2 of the stacking drums 1, 1 in such a manner that a part the respective wrapping rollers projects from openings 5 formed on the peripheries of the stacking drums 1, 1.

Spiral coin guides 6, 6 are formed integrally with the peripheries of the stacking drums 1, 1 for supporting coins by their upper faces. The spiral coin guides 6, 6 of the stacking drums 1, 1 are formed so as to extend in opposite directions but in phase with each other. The openings 5 are formed on peripheral regions which are not formed with the coin guides 6, 6.

A gear 7 is fixed to the lower portion of each of the shafts 4 of the wrapping rollers 3, 3 and this gear 7 is engaged with a gear 8 fixed to the shaft 2 of the stacking drum 1. Further, a gear 9 is secured to the lower end portion of the stacking drum 1 so as to be integral with the stacking drum 1 and rotatable with respect to the shaft 2.

Figure 4:
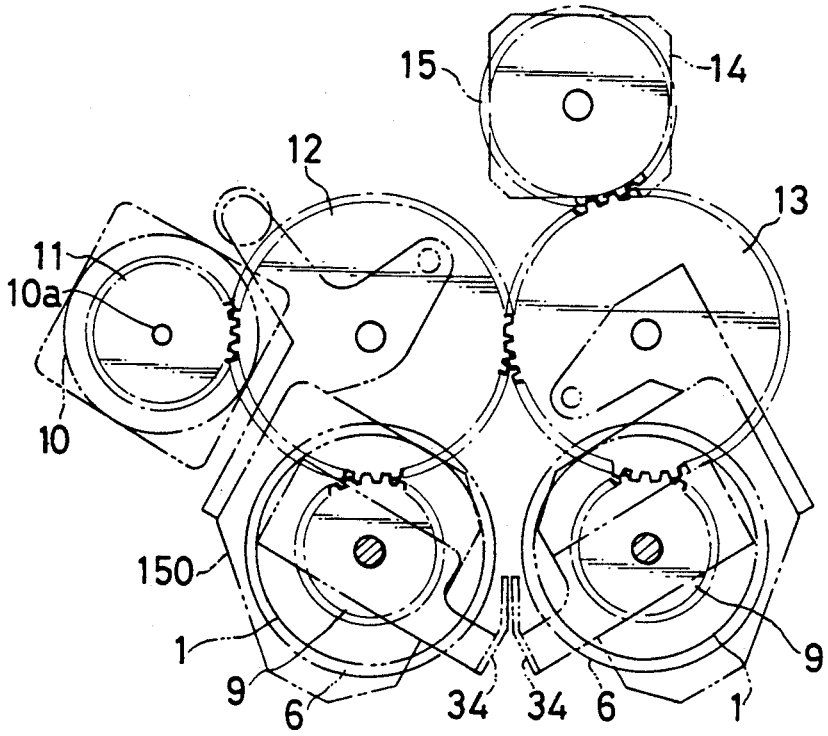
FIG. 4 is a schematic drawing showing a plan view of a pair of stacking drums and a rotation mechanism therefor.

As shown in plan view in FIG. 4, the driving force of a stacking drum drive motor 10 is transmitted via a plurality of gears in a known manner to the gears 9 integrally secured to the stacking drums 1, 1, thereby to rotate the stacking drums 1, 1 about the shafts 2 respectively. More specifically, the driving force of the stacking drum drive motor 10 is transmitted from a gear 11 fixed to a shaft 10*a* thereof to the gear 9 via a gear 12 or to the gear 9 via the gear 12 and a gear 13 engaged therewith, thereby to rotate the pair of stacking drums 1, 1. When the stacking drums 1, 1 are rotated, since the shafts 4 of the wrapping rollers 3, 3 are rotatably mounted on the stacking drums 1, 1, the wrapping rollers 3, 3 respectively revolve around the shafts 2 in accordance with the rotation of the stacking drums 1, 1 and at the same time, since the gears 7 fixed to the shafts 4 of the wrapping rollers 3, 3 are respectively engaged with the gears 8 fixed to the shafts 2, the wrapping rollers 3, 3 rotate together with the shafts 4. In FIG. 3, the stacking drum 1 disposed on the left side is constituted so as to rotate counterclockwise about the shaft 2 and the stacking drum 1 disposed on the right side is constituted so as to rotate clockwise, whereby the wrapping roller 3 disposed on the left side revolves counterclockwise around the shaft 2 together with the shaft 4 and rotates counterclockwise and the wrapping roller 3 disposed on the right side revolves clockwise around the shaft 2 and rotates clockwise. FIG. 3 shows a state where the stacking of coins C has been completed and a wrapping paper 120 has been wound around the stacked coins more than once.

As described above, in this embodiment, since the wrapping rollers 3, 3 are respectively arranged within the stacking drums 1, 1 and rotate in accordance with the rotation of the stacking drums 1, 1, when the stacking drums 1, 1 rotate, the wrapping rollers 3, 3 deviate from their desired positions and, as a result, there is some risk that the stacked coins cannot be wrapped in a desired manner. Therefore, in this embodiment, there is provided a gear 15 secured to a electromagnetic brake 14 and engaged with the gear 13 for locking the stacking drums 1, 1. The electromagnetic brake 14 is turned on when the wrapping paper 120 is fed to the periphery of the stacked coins C in the state where the stacking of coins C has been completed and there is a slight clearance between the wrapping rollers 3, 3 and the stacked coins C so as to stop the rotation of the gear 13 and the gear 12 and lock the pair of stacking drums 1, 1. Further, the electromagnetic brake 14 is turned off when the wrapping paper 120 has been wound around the stacked coins C substantially once so as to release the lock of the stacking drums 1, 1 and when stacking drums 1, 1 have further rotated until the stacked coins C are held among the wrapping rollers 3, 3 and a driven roller 35 explained later via the wrapping paper 120 and the coin wrapping is ready to start, the electromagnetic brake is turned on again so as to lock the pair of stacking drums 1, 1 again.

At the lower end portion of each of the shafts 2, a gear 16 is fixed and engaged with a gear 17 rotatably secured to the lower end portion of a frame-like arm member 150 for supporting the stacking drum 1.

The clearance between the pair of stacking drums 1, 1 is adjustable by a known mechanism so as to be the same as the width of a coin passage (not shown) for feeding coins between the pair of stacking drums 1, 1, that is, the diameter of coins to be stacked and wrapped.

Figure 5:
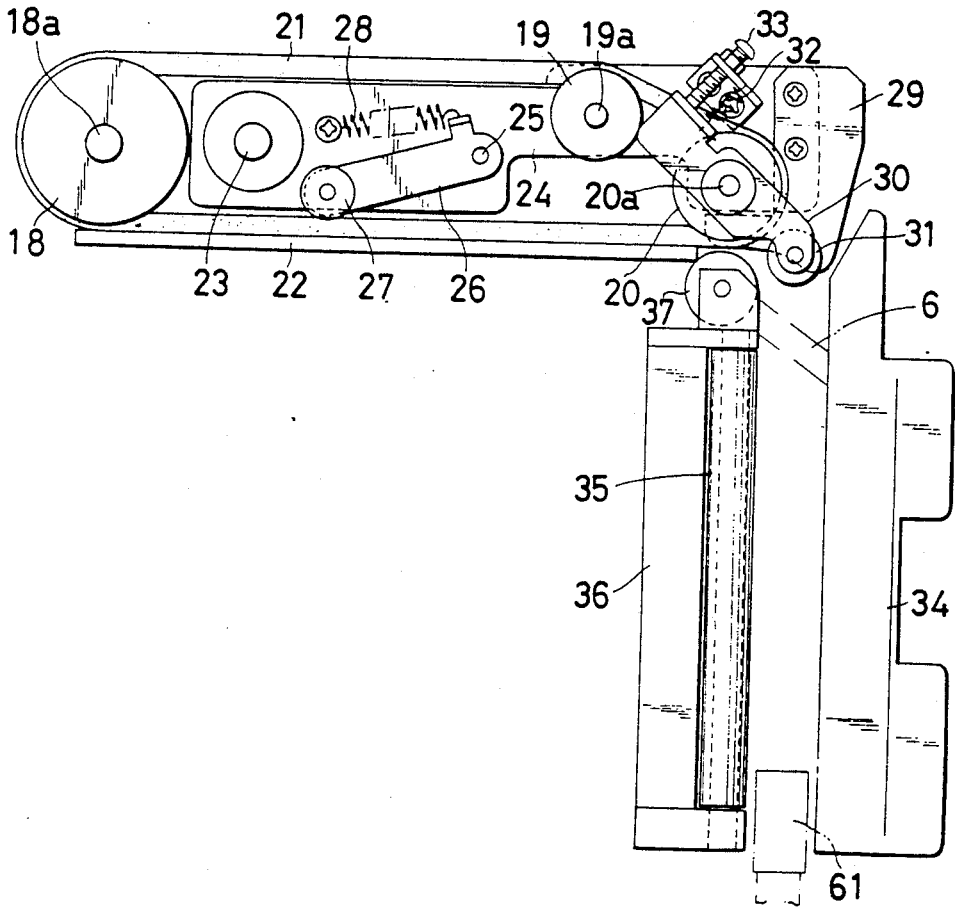
FIG. 5 is a schematic drawing showing a side view of a coin passage and a stacking drum.

As shown in the schematic side view of FIG. 5, the spiral coin guides 6, 6 formed on the peripheries of the respective stacking drums 1, 1 are formed to support coins in the opposite direction to that of conventional machines, that is, in such a manner that the leading portion thereof inclines downwardly with respect to the direction of coin transportation. In FIG. 5, the coins C are transported as held between the upper face of the coin passage 22 and a transporting belt 21 mounted on a pulley 18, a pulley 19 and a pulley 20 and fed to between the pair of stacking drums 1, 1. The transporting belt 21 is driven by a shaft 18*a* which fixes and supports the pulley 18, and the pulley 19 and the pulley 20 are rotatably supported by a shaft 19*a* and a shaft 20*a* respectively. The shaft 19*a* and the shaft 20*a* are fixed to a plate-like member 24 swingably supported by a shaft fixed to the body of the coin wrapping machine and the plate-like member 24 is biased about the shaft 23 clockwise in FIG. 5 by a spring (not shown). Accordingly, the transporting belt 21 is pressed onto the upper face of the coin passage 22 by the pulley 20. At substantially the central portion of the plate-like member 24, a shaft 25 which swingably supports a press member 26 is fixed and a press roller 27 is rotatably mounted on the opposite end portion of the press member 26 from the shaft 25. The press member 26 is biased about the shaft 25 counterclockwise in FIG. 5 by a spring 28, whereby the transporting belt 21 is always pressed onto the upper face of the coin passage 22 by the press roller 27. Although not shown, the coin passage 22 is formed with a small coin collecting opening for collecting coins having a smaller diameter than that of coins to be wrapped by allowing to drop therethrough. A guide plate 29 is fixed to the leading edge portion of the plate-like member 24 and the lower face of the guide plate 29 is formed to be curved so that the posture of coins C fed from the coin passage 22 to between the pair of stacking drums 1, 1 is controlled in such a manner that the leading portion of the coin can be gradually lowered. Further, a support plate 30 is swingably supported by the shaft 20*a*, at one end portion of which a guide roller 31 is rotatably mounted and at the other end portion of which a spring 32 is secured so as to bias the support plate 30 about the shaft 20*a* clockwise in FIG. 5. Accordingly, the coins C fed out from the coin passage 22 are immediately fed downwardly by the guide roller 31, thereby to prevent one coin C from colliding with the following coin C and coin jamming from occurring at the upper portion of the pair of stacking drums 1, 1. Further, there is provided an adjusting screw 33 for adjusting the position of the guide roller 31 in accordance with the denomination of coins C to be wrapped.

As shown in FIGS. 1, 4 and 5, there are provided, between the pair of stacking drums 1, 1, a pair of guide plates 34, 34 disposed downstream of the shafts 2 of the stacking drums 1, 1 with respect to the direction of coin transportation for guiding coins C to be stacked from the front side and a driven roller 35 disposed upstream of the wrapping rollers 3, 3 with respect to the coin transportation direction for guiding the coins C to be stacked from the rear side. The driven roller 35 is supported by a supporting block 36 so that the shaft thereof extends vertically and at the upper portion of the supporting block 36, a guide roller 37 is provided so as to be rotatable for enabling the coins C to be smoothly fed to between the pair of stacking drums 1, 1 from the coin passage 22.

Figure 6:
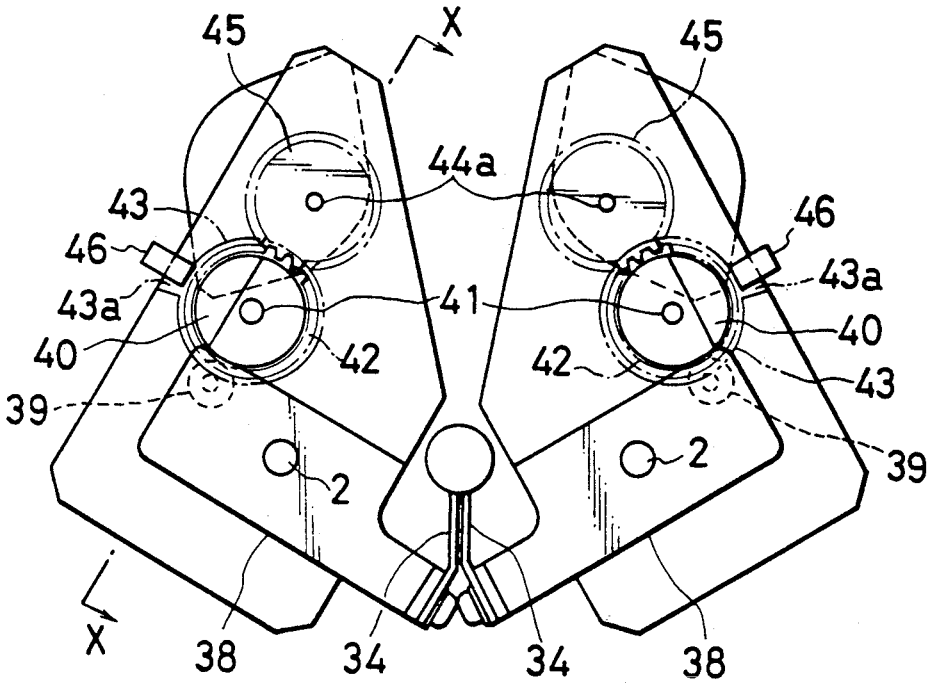
FIG. 6 is a schematic drawing showing a plan view of a guide plate and an opening and closing mechanism therefor.

The guide plates 34, 34 are constituted to be movable so that they are located at their stacking positions where they face a portion between the pair of stacking drums 1, 1 when stacking the coins C, while they are held at their retracted positions where they are spaced and retracted from their stacking position for feeding wrapping rollers 3, 3 to between the wrapping rollers 3, 3 when wrapping the coins C. In FIG. 6, a schematic plan view of a mechanism for moving the guide plates 34, 34 is shown and in FIG. 7, a view in the direction indicated by a line X—X is shown.

Figure 7:
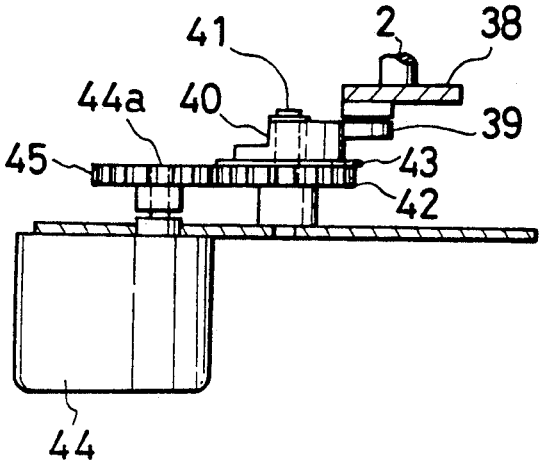
FIG. 7 is a schematic sectional view taken along line X—X in FIG. 6.

As shown in FIGS. 1, 2, 6 and 7, a swing arm 38 is swingably mounted on the upper and lower end portion of each of the shafts 2 of the stacking drums 1, 1 and each of the guide plates 34, 34 is fixed to the side face of one of the swing arms 38, 38. Cam followers 39, 39 are rotatably mounted at the swing arms 38, 38 respectively in such a manner that in FIGS. 1 and 6, the swing arm disposed on the left side is biased clockwise by a spring (not shown) and the swing arm disposed on the right side in FIGS. 1 and 6 is biased counterclockwise by a spring (not shown), whereby the respective cam followers 39, 39 abut against cams 40, 40, each of which is secured to the lower end portion of the frame-like arm member 150 for supporting the stacking drum 1 and has a half moon shaped cam lobe. As shown in FIG. 7, each of the cams 40, 40 is provided so as to be coaxial and integral with a gear 42 rotatably secured to a shaft 41 fixed to the lower end portion of the frame-like arm member 150 for supporting the stacking drum 1 and a rotation detection plate 43 is secured to a portion between the cam 40 and the gear 42. The gear 42 is engaged with a gear 45 fixed to a motor shaft 44*a* of a motor 44 fixed to the lower end portion of the frame-like arm member 150 for supporting the stacking drum 1. When the coins C have been stacked between the pair of stacking drums 1, 1 and the coin wrapping operation is started, the respective cams 40, 40 are rotated by the motors 44 and the respective swing arms 38, 38 are opened, whereby the guide plates 34, 34 are moved apart from each other and retracted to their retracted positions. Then, the cams 40, 40 are held in the state where they have been rotated a half turn and the coins C are wrapped. After the wrapping operation of coins C has been completed, the cams 40, 40 are further rotated a half turn, whereby the guide plates 34, 34 are returned to their stacking positions. A part of the periphery of the rotation detection plate 43 is formed with a projection 43*a* detectable by a sensor 46 so that it is detected that the cams 40, 40 have been rotated once when the sensor detects the projection 43*a* again.

Figure 8:
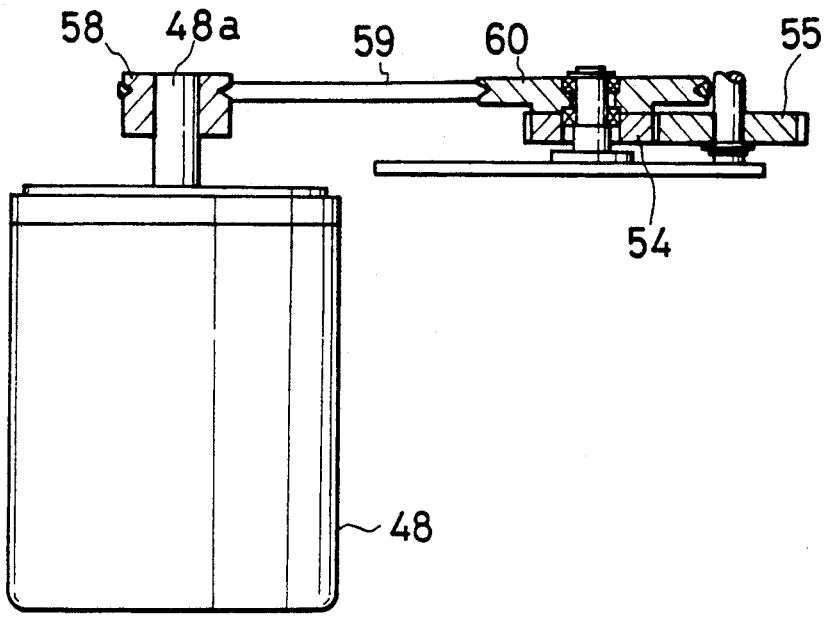
FIG. 8 is a schematic sectional view taken along line Y—Y in FIG. 1.
Figure 9:
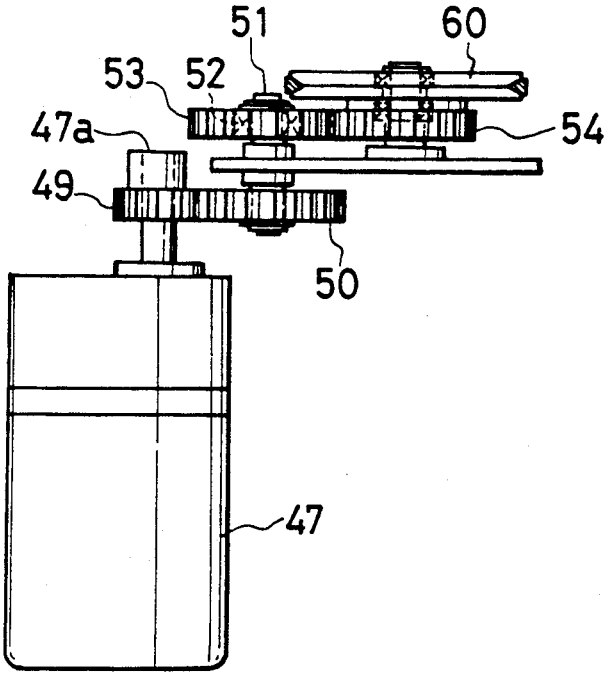
FIG. 9 is a schematic sectional view taken along line Z—Z in FIG. 1.

FIG. 8 is a schematic drawing viewed in the direction indicated by a line Y—Y in FIG. 1 and FIG. 9 is a schematic drawing viewed in the direction indicated by a line Z—Z in FIG. 1.

Referring to FIGS. 1, 8 and 9, the wrapping rollers are constituted so as to be selectively driven by a low speed motor 47 and a high speed motor 48. More specifically, in this embodiment, the pair of wrapping rollers 3, 3 are driven by the low speed motor 47 until after the pair of stacking drums 1, 1 have been rotated so that there is a slight clearance between the pair of wrapping rollers 3, 3 and the stacked coins C and the pair of stacking drums 1, 1 have been locked by the electromagnetic brake 14 and the wrapping paper 120 has been wound around the stacked coins C substantially once. Then, the locking of the pair of stacking drums 1, 1 is released and the pair of stacking drums 1, 1 are further rotated, whereby the stacked coins C are held among the pair of wrapping rollers 3, 3 and the driven roller 35 via the wrapping paper 120. Then, the pair of wrapping rollers 3, 3 are rotated by the high speed motor 48 and the stacked coins C are wrapped.

The driving force of the low speed motor 47 is, on one hand, transmitted from a gear 49 fixed to a motor shaft 47*a* to the wrapping roller 3 disposed within the stacking drum disposed on the left side in FIG. 1 via a gear 50, a shaft 51, a one-way clutch 52, a gear 53, a gear 54, a gear 55, the gear 17, the gear 16, the gear 8 and the gear 7 and on the other hand, transmitted from the gear 49 to the wrapping roller 3 disposed within the stacking drum disposed on the right side in FIG. 1 via a gear 50, a shaft 51, a one-way clutch 52, a gear 53, a gear 54, a gear 55, a gear 56, a gear 57, the gear 17, the gear 16, the gear 8 and the gear 7. The driving force of the high speed motor 48 is, on one hand, transmitted from a pulley 58 fixed to a motor shaft 48*a* to the wrapping roller 3 disposed within the stacking drum disposed on the left side in FIG. 1 via a transmission belt 59, a pulley 60, the gear 54 formed integrally with the pulley 60, a gear 55, the gear 17, the gear 16, the gear 8 and the gear 7 and on the other hand, transmitted from the pulley 58 fixed to the motor shaft 48*a* to the wrapping roller 3 disposed within the stacking drum disposed on the right side in FIG. 1 via the transmission belt 59, the pulley 60, the gear 54, a gear 55, a gear 56, a gear 57, the gear 17, the gear 16, the gear 8 and the gear 7. Accordingly, when the low speed motor 47 is driven, although the high speed motor 48 is rotated in accordance therewith, since the torque of the high speed motor 48 is low, the rotation of the high speed motor 48 does not produce any load with respect to the transmission of the driving force of the low speed motor 47. Further, when the high speed motor 48 is driven, although the gear 53 is rotated in accordance therewith, since the driving force of the high speed motor 48 is prevented from being transmitted to the side of the low speed motor by the one-way clutch 52, the load on the side of the low speed motor 47 does not affect the transmission of the driving force of the high speed motor 48.

Figure 10:
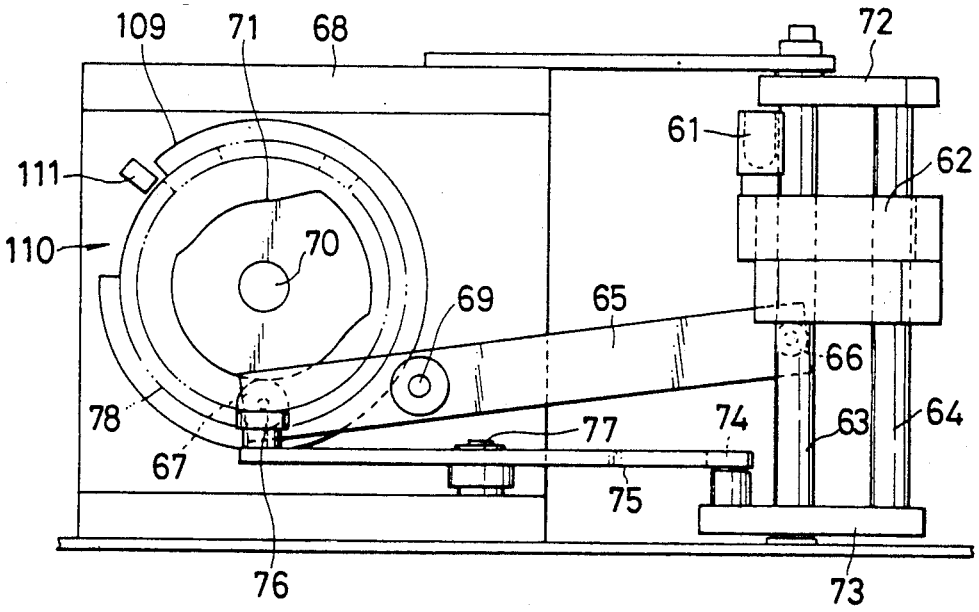
FIG. 10 is a schematic drawing showing a side view of a mechanism for elevating, lowering, advancing and retracting a coin support post for supporting coins.

FIG. 10 is a schematic drawing showing a side view of a mechanism for elevating, lowering, advancing and retracting a coin support post for supporting coins.

Referring to FIGS. 1 and 10, a coin support post 61 is adapted to receive and support the stacked coins C at its wrapping position after a predetermined number of coins C have been stacked between the pair of stacking drums 1, 1 and is fixed to one end portion of a post arm 62. A shaft 63 and a shaft 64 pass through the other end portion of the post arm 62. The lower end portion of the post arm 62 is supported by a roller 66 mounted on one end portion of a link 65. A cam follower 67 is mounted on the other end portion of the link 65. The link 65 is supported by a shaft 69 between the roller 66 and the cam follower 67 so as to be swingable about the shaft 69, which is fixed to the side face of a cam case 68. The cam follower 67 abuts against a cam 71 fixed to a cam shaft 70. Accordingly, by rotating the cam 71, the link 65 can be swung about the shaft 69 and the post arm 62 and the coin support post 61 can be elevated or lowered.

The shaft 63 is fixed to the body of the coin wrapping machine so as to be vertical. A connection member 72 is rotatably mounted on the shaft 63 in the vicinity of its upper end portion, and in the vicinity of the lower end portion of thereof, a connection member 73 is rotatably mounted thereon. In FIG. 1, the connecting member 72 is omitted. In the vicinity of one end portion of each of the connection members 72, 73, a shaft 64 is fixed parallel with the shaft 63 and at the other end portion of the connection member 73, a roller 74 is provided. One end portion of a link 75 abuts against the roller 74 and a cam follower 76 is provided at the other end portion of the link 75. The link 75 is supported by a shaft 77 between the end portion where it abuts against the roller 74 and the end portion where the cam follower 76 is provided so as to be swingable about the shaft 77, the shaft 77 being fixed to the bottom face of the cam case 68. The cam follower 76 abuts against a cam 78 fixed to the cam shaft 70. Accordingly, in accordance with the rotation of the cam 78, the link 75 can be swung about the shaft 77 and the post arm 62 can be swung about the shaft 63 via the connection member 73, whereby the coin support post 61 can advance to or retract from a portion between the pair of stacking drums 1, 1. Further, the link 75 is biased about the shaft 77 counterclockwise in FIG. 1 by a spring (not shown) and the connection member 73 is also biased about the shaft 63 counterclockwise in FIG. 1 by a spring (not shown) the spring force of which is weaker than that of the spring for biasing the link 75 so that the roller 74 always abuts against one end portion of the link 75 and the cam follower 76 always abuts against the cam 78. In this embodiment, the coin support post 61 is located between the pair of stacking drums 1, 1 and at its wrapping position where it is elevated to the highest level when stacking and wrapping coins C, and is lowered and further located at its retracted position apart from the portion between the pair of stacking drums 1, 1 after the wrapping of coins C has been completed and until the next stacking operation is started for stacking of a predetermined number of coins C.

Figure 11:
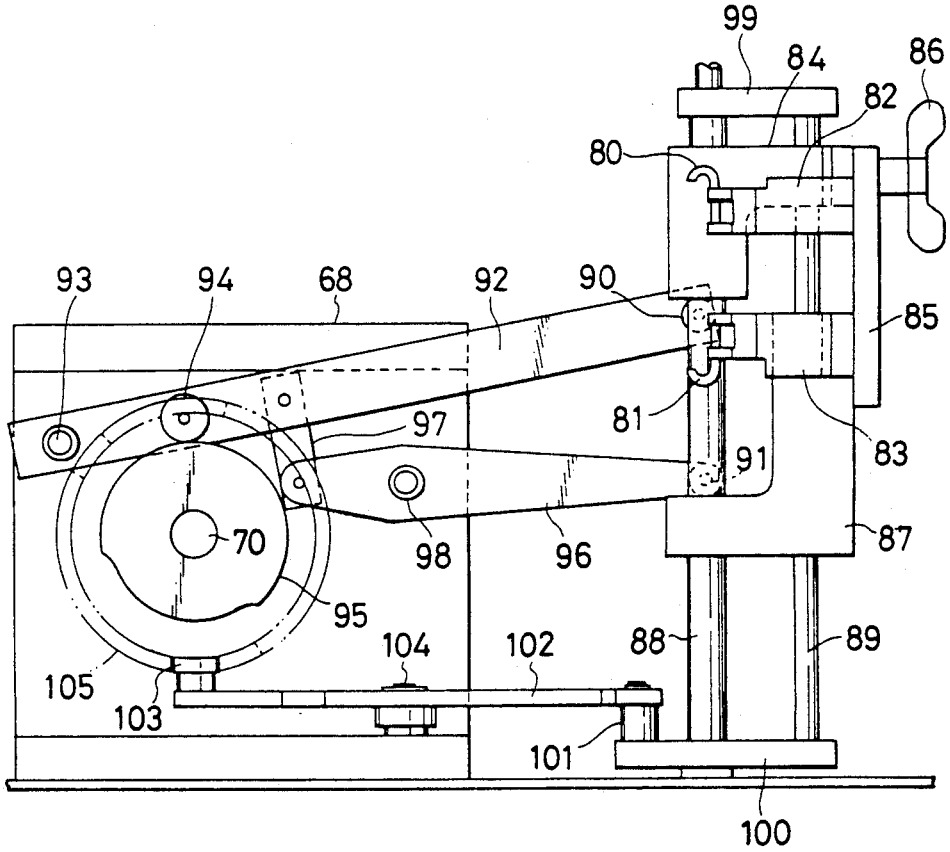
FIG. 11 is a schematic drawing showing a side view of a mechanism for elevating, lowering, advancing and retracting crimp claws for crimping wrapping paper wound around stacked coins.

FIG. 11 is a schematic drawing showing a side view of a mechanism for elevating, lowering, advancing and retracting crimp claws for crimping wrapping paper wound around stacked coins.

Referring to FIGS. 1 and 11, an upper crimp claw 80 and a lower crimp claw 81 are respectively fixed to an upper retaining member 82 and a lower retaining member 83, the upper crimp claw 80 and the lower crimp claw 81 being adapted to crimp the upper and lower end portions of the wrapping paper 120 wound around the stacked coins C. The upper retaining member 82 is secured to one end portion of an upper arm 84 and fixed to a fixed position adjusting plate 85 the position of which is adjustable. The adjusting plate 85 is fixed to the upper arm 84 by a wing-nut 86 after the vertical position thereof has been adjusted in accordance with the denomination of the coins C to be wrapped. The lower retaining member is directly fixed to one end portion of a lower arm 87. A shaft 88 and a shaft 89 respectively pass through the other end portions of the upper arm 84 and the lower arm 87. The upper arm 84 is biased downwardly by a spring (not shown) and the lower arm 87 is biased upwardly by a spring (not shown). Further, the upper arm 84 is prevented from moving downwardly by a roller 90 and the lower arm 87 is prevented from moving upwardly by a roller 91.

The roller 90 is mounted on one end portion of an upper link 92 and the other end portion of the upper link 92 is swingably supported by a shaft 93 fixed to the side face of the cam case 68. A cam follower 94 is provided on the side face of the upper link 92 between the roller 90 and the shaft 93 and abuts against a cam 95 fixed to the cam shaft 70. The roller 91 is mounted on one end portion of a lower link 96 and the other end portion of the lower link 96 is connected to the upper link 92 via a connecting link 97. The lower link 96 is swingably supported between the portion thereof where the roller 91 is mounted and the portion thereof where the connecting link 97 is connected by a shaft 98 so as to be swingable about the shaft 98, which is fixed to the side face of the cam case 68. Accordingly, in accordance with the rotation of the cam 95, the upper crimp claw 80 and the lower crimp claw 81 can be moved close to or apart from each other.

The shaft 88 is fixed to the body of the coin wrapping machine so as to be vertical. In the vicinity of the upper end portion of the shaft 88, a connection member 99 is rotatably mounted and in the vicinity of the lower end portion thereof, a connection member 100 is rotatably mounted. In FIG. 1, the connection member 99 is omitted. At one end portion of each of the connection members 99 and 100, the shaft 89 is fixed so as to be parallel with the shaft 88 and at the other end portion of the connection member 100, a roller 101 is provided. One end portion of a link 102 abuts against the roller 101 and a cam follower 103 is mounted on the other end portion of the link 102. The link 102 is supported between the portion where it abuts against the roller 101 and the cam follower 103 by a shaft 104 so as to be swingable about the shaft 104 fixed to the bottom face of the cam case 68. The cam follower 103 abuts against a cam 105 fixed to the cam shaft 70. Accordingly, in accordance with the rotation of the cam 105, since the link 102 is swung about the shaft 104 and the connection member 100 is swung about the shaft 88, the upper arm 84 and the lower arm 87 are swung about the shaft 88, whereby the upper crimp claw 80 and the lower crimp claw 81 can advance to or retract from the portion above or below the pair of stacking drums 1, 1. In this embodiment, when the wrapping paper 120 has been wound around the stacked coins C and the upper crimp claw 80 and the lower crimp claw 81 are ready to crimp the upper and lower end portion of the wrapping paper 120, the upper crimp claw 80 and the lower crimp claw 81 respectively move to the portion above and below the pair of stacking drums 1, 1 and further move closer to each other until reaching their crimp positions so that they crimp the upper and lower end portions of the wrapping paper 120. In other cases, the upper crimp claw 80 and the lower crimp claw 81 are spaced apart from each other and respectively located at their retracted positions, which are apart from the portions above and below the pair of stacking drums 1, 1.

The cam shaft 70 is driven by a motor 106 so that the driving force of the motor 106 is transmitted to the cam shaft 70 via a gear 107, a gear 108 and the like. One cycle of the stacking operation and the wrapping operation is completed during one rotation of the cam shaft 70. A sensor 111 detects that the cam shaft 70 has been rotated once by detecting a slit 110 of a rotation detection plate 109 which is fixed to the cam shaft 70 between the cam 71 and the cam 105.

Since the cam 71 and the cam 78 for moving the coin support post 61 between its stacking position and its retracted position, and the cam 95 and the cam 105 for moving the upper crimp claw 80 and the lower crimp claw 81 between their crimp positions and their retracted positions are fixed to the cam shaft, the cam profiles of these cams 71, 78, 95 and 105 are determined so that when the stacking of coins C is started, the coin support post 61 is located at its stacking position, when the cam shaft 70 is rotated by the motor 106 to move the upper crimp claw 80 and the lower crimp claw 81 to their crimp positions after the wrapping paper 120 has been wound around the stacked coins C and when the cam shaft 70 is rotated by the motor 106 to move the upper crimp claw 80 and the lower crimp claw 81 from their crimp positions to their retracted positions after the upper and lower end portions of the wrapping paper 120 have been crimped, the coin support post 61 is held at its stacking position and when the cam shaft 70 is rotated by the motor 106 to move the coin support post 61 from its stacking position to its retracted position, the upper crimp claw 80 and the lower crimp claw 81 are held at their retracted positions.

FIG. 3 shows a wrapping paper guiding apparatus. Conventionally, the wrapping paper 120 is guided by guide plates rotatably provided around the wrapping rollers 3 so that the leading edge thereof contacts the periphery of the stacked coins C. However, in this embodiment, since the wrapping rollers 3, 3 are disposed within the stacking drums 1, 1, it is difficult to arrange such guide plates around the wrapping rollers 3, 3. Therefore, in this embodiment, instead of the guide plates, there is provided the wrapping paper guiding apparatus comprising three nozzles 121*a*, 121*b* and 121*c* for blowing pressurized air onto the leading edge of the wrapping paper 120 and guiding the leading edge of the wrapping paper 120 onto the periphery of the stacked coins C. More specifically, the first nozzle 121*a* is provided downstream of the pair of wrapping rollers 3, 3 with respect to the coin transporting direction so that the blowing opening thereof faces a portion between the pair of wrapping rollers 3, 3 and the second nozzle 121*b* and the third nozzle 121*c* are provided upstream of the driven roller with respect to the coin transporting direction so that the blowing opening of the second nozzle 121*b* faces a portion between the driven roller 35 and one of the wrapping rollers 3, 3 and the blowing opening of the third nozzle 121*c* faces a portion between the driven roller 35 and the other wrapping roller 3. Further, the vertical positions of the first, second and third nozzles 121*a*, 121*b* and 121*c* correspond to substantially the central portion of the wrapping paper 120 in the widthwise direction thereof. The reason why the vertical positions of the nozzles 121*a*, 121*b* and 121*c* are determined so as to correspond to substantially the central portion of the wrapping paper 120 in the widthwise direction thereof is as follows. Since the edge of a cutter 122 for cutting the wrapping paper 120 is formed to be V-shaped in such a manner that the central portion thereof with respect to the widthwise direction of the wrapping paper 120 projects and, therefore, the leading edge of the wrapping paper 120 is also V-shaped in such a manner that the central portion thereof projects, it is ensured by determining the vertical positions of the nozzles 121*a*, 121*b* and 121*c* so as to correspond to substantially the central portion of the wrapping paper 120 with respect to the widthwise direction thereof that the pressurized air from the blowing openings of the nozzles 121*a*, 121*b* and 121*c* is blown against the leading edge of the wrapping paper 120 and the leading edge of the wrapping paper 120 is guided around the periphery of the stacked coins C in a desired manner. Further, since the height of the stacked coins C depends upon the denomination of the coins C and, therefore, the width of the wrapping paper 120 and the central position thereof in the widthwise direction depend upon the denomination of the coins C, there are provided a cutter height adjusting mechanism (not shown) for adjusting the vertical position of the cutter 122 and a nozzle height adjusting mechanism (not shown) for adjusting the vertical positions of the nozzles 121*a*, 121*b* and 121*c*. The nozzle height adjusting mechanism is constituted so as to adjust the vertical positions of the nozzles 121*a*, 121*b* and 121*c* in accordance with the vertical position of the cutter 122 adjusted by the cutter height adjusting mechanism.

Each of the nozzles 121*a*, 121*b* and 121*c* is controlled so as to blow the pressurized air toward the leading edge of the wrapping paper 120 when the leading edge of the wrapping paper 120 reaches a portion in front of the blowing opening thereof. More specifically, after a predetermined number of coins C have been stacked, the electromagnetic brake 14 is turned on in the state where there is a slight clearance between the wrapping rollers 3, 3 and the stacked coins C, whereby the stacking drums 1, 1 are locked. Then, the wrapping rollers 3, 3 are rotated by the low speed motor 47 at a low speed and the wrapping paper 120 is fed from a wrapping paper feed apparatus (not shown) to between the wrapping rollers 3, 3. When the leading edge of the wrapping paper 120 passes through a portion in front of the blowing opening of the first nozzle 121*a*, a solenoid valve (not shown) in the first nozzle 121*a* is opened, whereby the pressurized air supplied in advance to the nozzle 121*a* is blown through the blowing opening of the nozzle 121*a* toward the leading edge of the wrapping paper 120. As a result, the leading edge of the wrapping paper 120 is led along the periphery of the stacked coins C to a gap between the periphery of the stacked coins C and one of the wrapping rollers 3 and is further fed to a portion in front of the blowing opening of the second nozzle 121*b* by the wrapping paper feed apparatus. When the leading edge of the wrapping paper 120 passes through a portion in front of the blowing opening of the second nozzle 121*b*, a solenoid valve (not shown) in the second nozzle 121*b* is opened, whereby the pressurized air supplied in advance to the nozzle 121*b* is blown through the blowing opening of the nozzle 121*b* toward the leading edge of the wrapping paper 120. As a result, the leading edge of the wrapping paper 120 is led by the pressurized air along the periphery of the stacked coins C to a gap between the periphery of the stacked coins C and the driven roller 35 and is further fed to front of the blowing opening of the third nozzle 121*c*. Then, similarly, the pressurized air is blown from the blowing opening of the third nozzle 121*c* toward the leading edge of the wrapping paper 120, whereby the leading edge of the wrapping paper 120 is led to a gap between the stacked coins C and the other wrapping roller 3. At the time when the wrapping paper 120 has been wound around the stacked coins C substantially once in this manner, the electromagnetic brake 14 is turned off and the locking of the stacking drums 1, 1 is released. Then, as shown in FIG. 3, the stacking drum 1 disposed on the left side is slightly rotated counterclockwise and the stacking drum 1 disposed on the right side is slightly rotated clockwise by the stacking drum drive motor 10, whereby the stacked coins C are held among the wrapping rollers 3, 3 and the driven roller 35 via the wrapping paper 120. At the same time, the wrapping rollers 3, 3 which have been rotated by the low speed motor 47 so far are rotated by the high speed motor 48. When the wrapping paper 120 has been wound around the stacked coins C substantially twice, the wrapping operation of the coins C is complete. Since the wrapping paper 120 has been wound around the periphery of the stacked coins C substantially once when the wrapping rollers 3, 3 are rotated by the high speed motor 48, it is no longer necessary to guide the leading edge of the wrapping paper 120 and, therefore, after the low speed motor 47 has been changed over to the high speed motor 48, the nozzles 121*a*, 121*b* and 121*c* stop blowing the pressurized air. Since the wrapping rollers 3, 3 are rotated by the low speed motors 47 until the wrapping paper 120 has been wound around the stacked coins C substantially once, it is possible to reliably lead the leading edge of the wrapping paper 120 along the periphery of the stacked coins C by air pressure of the pressurized air blown from the nozzles 121*a*, 121*b* and 121*c*.

In the thus constituted coin wrapping machine, a predetermined number of coins C are wrapped in the following manner.

Coins deposited into the coin wrapping machine are fed onto a rotatable disk (not shown) and transported one by one on the coin passage 22 toward the pair of stacking drums 1, 1 in a state of being pressed onto the upper face of the coin passage 22 by the transporting belt 21 in a known manner. Although not shown, there are provided in the coin passage 22, as known, a sensor for counting the number of coins and a stopper for preventing the following coins from being transported when a predetermined number of coins C have been counted by the sensor and have been fed to a portion between the pair of stacking drums 1, 1.

The pair of stacking drums 1, 1 are rotated by the stacking drum drive motor 10 so that the stacking drum 1 disposed on the left side in FIG. 3 is rotated counterclockwise and that the stacking drum 1 disposed on the right side in FIG. 3 is rotated clockwise. Each of the coins C fed out from the coin passage 22 to a portion between the pair of stacking drums 1, 1 is oriented by the guide plate 29 so that the leading side thereof is lowered with respect to the coin transportation direction and is immediately fed downwardly by the roller 31, whereby it is supported by the spiral coin guides 6, 6, each formed on the periphery of one of the stacking drums 1, 1 so that the leading side thereof is lowered with respect to the coin transportation direction and further fed downwardly in accordance with the pair of stacking drums 1, 1. Since when stacking of coins C is started, the guide plates 34, 34 are located at their stacking positions, the leading sides of coins C are guided by the guide plates 34, 34 and the coins C are stacked between the pair of stacking drums 1, 1 in a desired manner. When the pair of stacking drums rotate, each of the wrapping rollers 3, 3 rotates about its shaft 4 and revolves around the shaft 2. Thus, the coins C are successively fed to a portion between the pair of stacking drums 1, 1. When a predetermined number of coins C have been stacked between the pair of stacking drums 1, 1 and the wrapping rollers 3, 3 reach a position where a slight clearance is present between the wrapping rollers 3, 3 and the stacked coins C, the rotation of the pair of stacking drums 1 1 is stopped and the electromagnetic brake 14 is turned on, whereby the pair of stacking drums 1, 1 are locked and stacking of coins C is completed. When stacking of coins C is started, the coin support post 61 is located at its wrapping position and the predetermined number of stacked coins are delivered to the upper face of the coin support post 61.

When the pair of stacking drums 1, 1 are locked, the motor 44 rotates the cam 40, thereby to retract the guide plates 34, 34 which have been guiding the coins C during stacking of coins C from their stacking position where they face the pair of stacking drums 1, 1 to their retracted position for enabling the wrapping paper 120 to be fed to a portion between the stacked coins C and the wrapping rollers 3, 3. Then, the wrapping paper 120' is fed by the wrapping paper feed apparatus (not shown) and pressurized air is blown from the respective nozzles 121*a*, 121*b* and 121*c* toward the leading edge of the wrapping paper 120 when the leading edge of the wrapping paper 120 comes in front of the blowing openings of the respective nozzles 121*a*, 121*b* and 121*c* so as to guide the leading edge of the wrapping paper 120 along the periphery of the stacked coins C. At the same time, the wrapping rollers 3, 3 are rotated by the low speed motor 47 at a low speed so that their circumferential speed equals the feed speed of the wrapping paper 120 from the wrapping paper feed apparatus. Accordingly, considerable air pressure can act on the leading edge of the wrapping paper 120 from the nozzles 121*a*, 121*b* and 121*c* and the wrapping paper 120 is reliably led to the stacked coins C and wound around the stacked coins C.

Thus, when the wrapping paper 120 has been wound around the stacked coins C substantially once, the electromagnetic brake 14 is turned off thereby to release the locking of the pair of stacking drums 1, 1 and the pair of stacking drums 1, 1 are slightly rotated by the stacking drum drive motor 10 until the wrapping rollers 3, 3 and the driven roller 35 hold the stacked coins C via the wrapping paper 120. Then the electromagnetic brake 14 is turned on again and the pair of stacking drums 1, 1 are locked again. Then, the motor for rotating the wrapping rollers 3, 3 is changed over from the low speed motor 47 to the high speed motor 48 and the wrapping paper 120 is wound around the stacked coins C at a high speed. Since the wrapping paper 120 has been already wound around the stacked coins C substantially once at the time when the motor is changed over from the low speed motor 47 to the high speed motor 48, it is no longer necessary to guide the leading edge of the wrapping paper 120 and, therefore, the nozzles 121*a*, 121*b* and 121*c* stop blowing the pressurized air. When the wrapping paper 120 has been wound around the stacked coins C substantially twice, the wrapping paper feed apparatus stops feeding the wrapping paper 120 and the wrapping paper 120 is pressed onto the cutter 122 by the tensile force produced by the rotation of the wrapping rollers 3, 3, and cut.

After cutting of the wrapping paper 120, the cam shaft 70 is rotated by the motor 106 and the upper crimp claw 80 and the lower crimp claw 81, which have been located at their retracted positions apart from the pair of stacking drums 1, 1 so far, are moved to their crimp positions, thereby to crimp the upper and lower end portions of the wrapping paper 120 wound around the stacked coins C and then retracted to their retracted positions.

Then, the cam shaft 70 is rotated by the motor 106 so that the coin support post 61, which has been supporting the stacked coins C so far, is lowered and further moved to its retracted position.

Thus, after the upper crimp claw 80, the lower crimp claw 81 and the coin support post 61 have been moved to their retracted positions, the electromagnetic brake 14 is turned off, thereby to release the locking of the pair of stacking drums 1, 1 and the stacking drum 1 disposed on the left side in FIG. 3 is rotated clockwise, while the stacking drum 1 disposed on the right side in FIG. 3 is rotated counterclockwise. As a result, the stacked coins C around which the wrapping paper 120 has already been wound become no longer held by the pair of wrapping rollers 3, 3 and the driven roller 35 and fall from a portion between the pair of stacking drums 1, 1 to be collected in a known manner.

As described above, when the pair of stacking drums 1, 1 is rotated until they reach their waiting positions where they were located before starting the stacking operation of coins C, one cycle of stacking and wrapping coins C is completed and the guide plates 34, 34 have been returned to their stacking positions where they face the pair of stacking drums 1, 1 and the coin support post 61 has been returned to its stacking position where it faces the pair of stacking drums 1, 1 prior to starting the next stacking operation of coins C.

According to this embodiment, since the leading edge of the wrapping paper 120 is guided along the periphery of the stacked coins C by the pressurized air blown from the nozzles 121*a*, 121*b* and 121*c*, even when the denomination of coins C to be wrapped is changed, it is unnecessary to change the horizontal positions of the nozzles 121*a*, 121*b* and 121*c* and it is also unnecessary to provide a mechanism for adjusting the horizontal positions of means for guiding the leading edge of the wrapping paper 120. Therefore, it is possible to make the wrapping paper guide apparatus considerably more compact and make the structure thereof considerable simpler, thereby enabling the coin wrapping machine to be made markedly more compact. Further, since each of the wrapping rollers 3, 3 is disposed within one of the stacking drums 1, 1, the coin wrapping machine can be made considerably more compact than conventional machines.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although each of the wrapping rollers 3, 3 is disposed within one of the stacking drums 1, 1, the present invention is not limited to a coin wrapping machine having such an arrangement but can be applied to a coin wrapping machine having the conventional arrangement in which a plurality of wrapping rollers are disposed below a pair of stacking drums.

Further, in the above described embodiment, although the cams 71, 78, 95 and 105 are fixed to the same cam shaft 70, if the coin support post 61, the upper crimp claw 80 and the lower crimp claw 81 are moved with the same timing as that of the above described embodiment, a part or all of them may be fixed to different cam shafts.

Furthermore, in the above described embodiment, although the pressurized air is blown from the nozzles 121*a*, 121*b* and 121*c* only when the wrapping rollers 3 are being rotated by the low speed motor 47, the pressurized air may be also blown during the rotation of the wrapping rollers.

Moreover, in the above described embodiment, although the stacked coins are held among the pair of wrapping rollers 3, 3 and the driven roller 35, it is possible instead of the driven roller 35 to employ a drive roller which is rotated at the same circumferential speed as that of the wrapping rollers 3, 3.

I claim:

1. A coin wrapping machine having a pair of vertical stacking drums rotatable in opposite directions, spiral coin support guide means formed on the pair of stacking drums for supporting coins by their upper faces and stacking the coins between the drums, means for rotating said drums, means for horizontally transporting said coins in between said drums, and a plurality of wrapping rollers for wrapping the thus stacked coins, said coin wrapping machine further including a plurality of pressurized air blowing means which are disposed in such a manner that a blowing opening of each pressurized air blowing means faces a portion between said wrapping rollers and are adapted to blow pressurized air toward a leading edge of a wrapping paper, wherein the pair of stacking drums are hollow, the plurality of wrapping rollers includes a pair of wrapping rollers, one of said wrapping rollers being disposed in each stacking drum in such a manner that a part thereof projects from an opening formed on a periphery of the stacking drum and that when coins are being wrapped, the coins can be held by the wrapping rollers and coin holding means disposed upstream of the pair of wrapping rollers with respect to a coin transportation direction, means for feeding a wrapping material between said wrapping rollers and means for rotating said rollers to wrap the coins and said plurality of pressurized air blowing means include first, second and third pressurized air blowing means provided in such a manner that a blowing opening of the first pressurized air blowing means faces a portion between the pair of wrapping rollers, a blowing opening of the second pressurized air blowing means faces a portion between the coin holding means and one of the wrapping rollers and a blowing opening of the third pressurized air blowing means faces a portion between the coin holding means and the other wrapping rollers.

2. A coin wrapping machine in accordance with claim 1 which further includes cutter means for cutting the wrapping paper and cutter position adjusting means for adjusting the vertical position of the cutter means, the vertical positions of said pressurized air blowing means being adjustable in accordance with the vertical position of the cutter means adjusted by said cutter position adjusting means.

3. A coin wrapping machine in accordance with claim 1 which further includes cutter means for cutting the wrapping paper and cutter position adjusting means for adjusting the vertical position of the cutter means, the vertical positions of said pressurized air blowing means being adjustable in accordance with the vertical position of the cutter means adjusted by said cutter position adjusting means.

4. A coin wrapping machine in accordance with claim 1 which further includes low speed motor means and high speed motor means for rotating the plurality of wrapping rollers in such a manner that the plurality of wrapping rollers are rotated by said low speed motor means until the wrapping paper has been wound around the periphery of the stacked coins substantially once and then rotated by said high speed motor means.

5. A coin wrapping machine in accordance with claim 1 which further includes low speed motor means and high speed motor means for rotating the pair of wrapping rollers in such a manner that the plurality of wrapping rollers are rotated by said low speed motor means until the wrapping paper has been wound around the periphery of the stacked coins substantially once and then rotated by said high speed motor means.

6. A coin wrapping machine in accordance with claim 2 which further includes low speed motor means and high speed motor means for rotating the plurality of wrapping rollers in such a manner that the plurality of wrapping rollers are rotated by said low speed motor means until the wrapping paper has been wound around the periphery of the stacked coins substantially once and then rotated by said high speed motor means.

7. A coin wrapping machine in accordance with claim 3 which further includes low speed motor means and high speed motor means for rotating the pair of wrapping rollers in such a manner that the plurality of wrapping rollers are rotated by said low speed motor means until the wrapping paper has been wound around the periphery of the stacked coins substantially once and then rotated by said high speed motor means.

8. A coin wrapping machine in accordance with claim 1 which further includes a guide roller biased downwardly and disposed above the pair of stacking drums.

9. A coin wrapping machine in accordance with claim 3 which further includes a guide roller biased downwardly and disposed above the pair of stacking drums.

10. A coin wrapping machine in accordance with claim 5 which further includes a guide roller biased downwardly and disposed above the pair of stacking drums.

11. A coin wrapping machine in accordance with claim 7 which further includes a guide roller biased downwardly and disposed above the pair of stacking drums.

12. A coin wrapping machine in accordance with claim 1 which further includes coin support means capable of advancing to and retracting from a portion below said pair of stacking drums, located at a position where it is elevated at the highest level after coin stacking was started until coin wrapping has been completed and adapted to receive the stacked coins after the coin stacking has been completed prior to wrapping coins and to support the stacked coins during the coin wrapping.

13. A coin wrapping machine in accordance with claim 3 which further includes coin support means capable of advancing to and retracting from a portion below said pair of stacking drums, located at a position where it is elevated at the highest level after coin stacking was started until coin wrapping has been completed and adapted to receive the stacked coins after the coin stacking has been completed prior to wrapping coins and to support the stacked coins during the coin wrapping.

14. A coin wrapping machine in accordance with claim 5 which further includes coin support means capable of advancing to and retracting from a portion below said pair of stacking drums, located at a position where it is elevated at the highest level after coin stacking was started until coin wrapping has been completed and adapted to receive the stacked coins after the coin stacking has been completed prior to wrapping coins and to support the stacked coins during the coin wrapping.

15. A coin wrapping machine in accordance with claim 7 which further includes coin support means capable of advancing to and retracting from a portion below said pair of stacking drums, located at a position where it is elevated at the highest level after coin stacking was started until coin wrapping has been completed and adapted to receive the stacked coins after the coin stacking has been completed prior to wrapping coins and to support the stacked coins during the coin wrapping.

16. A coin wrapping machine in accordance with claim 8 which further includes coin support means capable of advancing to and retracting from a portion below said pair of stacking drums, located at a position where it is elevated at the highest level after coin stacking was started until coin wrapping has been completed and adapted to receive the stacked coins after the coin stacking has been completed prior to wrapping coins and to support the stacked coins during the coin wrapping.

17. A coin wrapping machine in accordance with claim 9 which further includes coin support means capable of advancing to and retracting from a portion below said pair of stacking drums, located at a position where it is elevated at the highest level after coin stacking was started until coin wrapping has been completed and adapted to receive the stacked coins after the coin stacking has been completed prior to wrapping coins and to support the stacked coins during the coin wrapping.

18. A coin wrapping machine in accordance with claim 10 which further includes coin support means capable of advancing to and retracting from a portion below said pair of stacking drums, located at a position where it is elevated at the highest level after coin stacking was started until coin wrapping has been completed and adapted to receive the stacked coins after the coin stacking has been completed prior to wrapping coins and to support the stacked coins during the coin wrapping.

19. A coin wrapping machine in accordance with claim 11 which further includes coin support means capable of advancing to and retracting from a portion below said pair of stacking drums, located at a position where it is elevated at the highest level after coin stacking was started until coin wrapping has been completed and adapted to receive the stacked coins after the coin stacking has been completed prior to wrapping coins and to support the stacked coins during the coin wrapping.

20. A coin wrapping machine in accordance with claim 1 wherein said coin holding means comprises a driven roller adapted for guiding the coins when the coins are being stacked and holding the stacked coins among itself and said pair of wrapping rollers when the coins are being wrapped.

21. A coin wrapping machine in accordance with claim 3 wherein said coin holding means comprises a driven roller adapted for guiding the coins when the coins are being stacked and holding the stacked coins among itself and said pair of wrapping rollers when the coins are being wrapped.

22. A coin wrapping machine in accordance with claim 5 wherein said coin holding means comprises a driven roller adapted for guiding the coins when the coins are being stacked and holding the stacked coins among itself and said pair of wrapping rollers when the coins are being wrapped.

23. A coin wrapping machine in accordance with claim 7 wherein said coin holding means comprises a driven roller adapted for guiding the coins when the coins are being stacked and holding the stacked coins among itself and said pair of wrapping rollers when the coins are being wrapped.

24. A coin wrapping machine in accordance with claim 8 wherein said coin holding means comprises a driven roller adapted for guiding the coins when the coins are being stacked and holding the stacked coins among itself and said pair of wrapping rollers when the coins are being wrapped.

25. A coin wrapping machine in accordance with claim 9 wherein said coin holding means comprises a driven roller adapted for guiding the coins when the coins are being stacked and holding the stacked coins among itself and said pair of wrapping rollers when the coins are being wrapped.

26. A coin wrapping machine in accordance with claim 10 wherein said coin holding means comprises a driven roller adapted for guiding the coins when the coins are being stacked and holding the stacked coins among itself and said pair of wrapping rollers when the coins are being wrapped.

27. A coin wrapping machine in accordance with claim 11 wherein said coin holding means comprises a driven roller adapted for guiding the coins when the coins are being stacked and holding the stacked coins among itself and said pair of wrapping rollers when the coins are being wrapped.

28. A coin wrapping machine in accordance with claim 12 wherein said coin holding means comprises a driven roller adapted for guiding the coins when the coins are being stacked and holding the stacked coins among itself and said pair of wrapping rollers when the coins are being wrapped.

29. A coin wrapping machine in accordance with claim 13 wherein said coin holding means comprises a driven roller adapted for guiding the coins when the coins are being stacked and holding the stacked coins among itself and said pair of wrapping rollers when the coins are being wrapped.

30. A coin wrapping machine in accordance with claim 14 wherein said coin holding means comprises a driven roller adapted for guiding the coins when the coins are being stacked and holding the stacked coins among itself and said pair of wrapping rollers when the coins are being wrapped.

31. A coin wrapping machine in accordance with claim 15 wherein said coin holding means comprises a driven roller adapted for guiding the coins when the coins are being stacked and holding the stacked coins among itself and said pair of wrapping rollers when the coins are being wrapped.

32. A coin wrapping machine in accordance with claim 16 wherein said coin holding means comprises a driven roller adapted for guiding the coins when the coins are being stacked and holding the stacked coins among itself and said pair of wrapping rollers when the coins are being wrapped.

33. A coin wrapping machine in accordance with claim 12 wherein said coin holding means comprises a driven roller adapted for guiding the coins when the coins are being stacked and holding the stacked coins among itself and said pair of wrapping rollers when the coins are being wrapped.

34. A coin wrapping machine in accordance with claim 18 wherein said coin holding means comprises a driven roller adapted for guiding the coins when the coins are being stacked and holding the stacked coins among itself and said pair of wrapping rollers when the coins are being wrapped.

35. A coin wrapping machine in accordance with claim 19 wherein said coin holding means comprises a driven roller adapted for guiding the coins when the coins are being stacked and holding the stacked coins among itself and said pair of wrapping rollers when the coins are being wrapped.

* * * * *